US007446734B2

(12) United States Patent
Kigo et al.

(10) Patent No.: US 7,446,734 B2
(45) Date of Patent: Nov. 4, 2008

(54) METHOD OF DRIVING PLASMA DISPLAY PANEL

(75) Inventors: Shigeo Kigo, Osaka (JP); Minoru Takeda, Osaka (JP); Yasuaki Mutou, Osaka (JP)

(73) Assignee: Matsushita Electric Industrial Co., Ltd, Osaka (JP)

( * ) Notice: Subject to any disclaimer, the term of this patent is extended or adjusted under 35 U.S.C. 154(b) by 379 days.

(21) Appl. No.: 10/566,328

(22) PCT Filed: May 11, 2005

(86) PCT No.: PCT/JP2005/009020

§ 371 (c)(1),
(2), (4) Date: Jan. 27, 2006

(87) PCT Pub. No.: WO2005/109388

PCT Pub. Date: Nov. 17, 2005

(65) Prior Publication Data

US 2006/0284796 A1 Dec. 21, 2006

(30) Foreign Application Priority Data

May 11, 2004 (JP) ..... 2004-140795

(51) Int. Cl.
*G09G 3/28* (2006.01)

(52) U.S. Cl. ..... 345/60; 345/66

(58) Field of Classification Search ..... 345/37, 345/41, 60–62, 66–72; 315/169.1, 169.3, 315/169.4

See application file for complete search history.

(56) References Cited

U.S. PATENT DOCUMENTS

| | | | | |
|---|---|---|---|---|
| 6,512,501 | B1 * | 1/2003 | Nagaoka et al. | 345/66 |
| 7,109,951 | B2 * | 9/2006 | Kim et al. | 345/63 |
| 2002/0021264 | A1 * | 2/2002 | Nakamura | 345/60 |
| 2002/0167468 | A1 | 11/2002 | Hashimoto et al. | |
| 2004/0095295 | A1 * | 5/2004 | Nagao et al. | 345/60 |

FOREIGN PATENT DOCUMENTS

| | | | |
|---|---|---|---|
| JP | 11-352924 | A | 12/1999 |
| JP | 2000-242224 | A | 9/2000 |
| JP | 2002-278510 | A | 9/2002 |
| JP | 2003-280575 | A | 10/2003 |

OTHER PUBLICATIONS

International Search Report for application No. PCT/JP2005/009020 dated Aug. 23, 2005.

* cited by examiner

*Primary Examiner*—Richard Hjerpe
*Assistant Examiner*—Mansour M Said
(74) *Attorney, Agent, or Firm*—RatnerPrestia

(57) ABSTRACT

In the initializing period of each of sub-fields comprising one field, one of all-cell initializing operation and selective initializing operation is performed. The all-cell initializing operation causes initializing discharge in all the discharge cells for displaying an image. The selective initializing operation selectively causes initializing discharge only in the discharge cells subjected to sustaining discharge in the preceding sub-field. During initializing discharge using scan electrodes as anodes, and using sustain electrodes and data electrodes as cathodes in the all-cell initializing period, applying, to the data electrodes, a voltage for delaying discharge using the data electrodes as the cathodes, after discharge using the sustain electrodes as the cathodes.

1 Claim, 4 Drawing Sheets

METHOD OF DRIVING PLASMA DISPLAY PANEL

TECHNICAL FIELD

The present invention relates to a method of driving a plasma display panel.

BACKGROUND ART

An alternating-current surface-discharging panel representing plasma display panels (hereinafter abbreviated as "panels") has a large number of discharge cells formed between a front panel and rear panel faced with each other. In the front panel, a plurality of display electrodes, each made of a pair of scan electrode and sustain electrode, are formed on a front glass substrate in parallel with each other. A dielectric layer and a protective layer are formed to cover these display electrodes. In the rear panel, a plurality of parallel data electrodes is formed on a rear glass substrate. A dielectric layer is formed on the data electrodes to cover them. Further, a plurality of barrier ribs is formed on the dielectric layer in parallel with the data electrodes. Phosphor layers are formed on the surface of the dielectric layer and the side faces of the barrier ribs. Then, the front panel and the rear panel are faced with each other and sealed together so that the display electrodes and data electrodes intersect with each other. A discharge gas is filled into an inside discharge space formed therebetween. Discharge cells are formed in portions where respective display electrodes are opposed to corresponding data electrodes. In a panel structured as above, ultraviolet light is generated by gas discharge in each discharge cell. This ultraviolet light excites respective phosphors of R, G, and B colors, to emit respective colors for color display.

A general method of driving a panel is a sub-field method: one field period is divided into a plurality of sub-fields and combination of light-emitting sub-fields provides gradation display. Among the sub-field method, a novel driving method of minimizing the light emission unrelated to gradation display to inhibit an increase in black picture level and improve a contrast ratio is disclosed in Japanese Patent Unexamined Publication No. 2000-242224.

The driving method is briefly described hereinafter. Each sub-field has an initializing period, writing period, and sustaining period. In the initializing period, one of all-cell initializing operation and selective initializing operation is performed. The all-cell initializing operation causes initializing discharge in all the discharge cells for image display. The selective discharge operation selectively causes initializing discharge in the discharge cells subjected to sustaining discharge in the preceding sub-filed.

First, in the all-cell initializing period, all the discharge cells perform initializing discharge operation at a time, to erase the history of wall electric charge previously formed in respective discharge cells and form wall electric charge necessary for the subsequent writing operation. Additionally, this initializing discharge operation serves to generate priming (priming for discharge=excited particles) for reducing discharge delay and causing stable writing discharge. In the subsequent writing period, scan pulses are sequentially applied to scan electrodes, and write pulses corresponding to the signals of an image to be displayed are applied to data electrodes. Thus, selective writing discharge is caused between the scan electrodes and corresponding data electrodes to selectively form wall electric charge. In the sustaining period, a predetermined number of sustain pulses according to a brightness weight is applied between the scan electrodes and corresponding sustain electrodes. Then, the discharge cells in which wall electric charge has been formed by the writing discharge are selectively discharged so that light is emitted from the discharge cells.

In this manner, to properly display an image, selective writing discharge must securely be performed in the writing period. For this purpose, ensuring initializing operation, i.e. preparation for the writing operation, is important.

In the all-cell initializing operation, it is necessary to cause initializing discharge using the scan electrodes as anodes and the sustain electrodes and data electrodes as cathodes. However, phosphors having smaller electron emission factors that are applied to the data electrodes may increase discharge delay in the initializing discharge using the data electrodes as cathodes, thus causing unstable initializing discharge in some cases.

Additionally, considerations are given to increasing the partial pressure of xenon in the discharge gas filled into the panel to improve the luminous efficiency of the panel. However, an increase in the partial pressure of xenon destabilizes discharge, especially initializing discharge. This unstable discharge poses a problem of writing failure in the subsequent writing period that is caused by a narrower margin of the driving voltage in the wiring operation.

The present invention addresses these problems and aims to provide a method of driving a panel in which stabilization of initial discharge allows images to be displayed in excellent quality.

SUMMARY OF THE INVENTION

A method of driving a plasma display panel of the present invention, the plasma display panel including discharge cells, each formed at an intersection of a scan electrode and a sustain electrode, and a data electrode, the method comprising: dividing one field period into a plurality of sub-fields, each having an initializing period, writing period, and sustaining period; in the initializing periods of the plurality of sub-fields, performing one of all-cell initializing operation and selective initializing operation, wherein, the all-cell initializing operation causes initializing discharge in all the discharge cells for displaying an image, and the selective initializing operation selectively causes initializing discharge only in the discharge cells subjected to sustaining discharge in the preceding sub-field; and during initializing discharge using the scan electrodes as anodes, and using the sustain electrodes and data electrodes as cathodes in the initializing period for performing the all-cell initializing operation, applying, to the data electrodes, a voltage for delaying discharge using the data electrodes as the cathodes, after discharge using the sustain electrodes as the cathodes.

DETAILED DESCRIPTION OF PREFERRED EMBODIMENT

A method of driving a panel in accordance with an exemplary embodiment of the present invention is described hereinafter with reference to the accompanying drawings.

Exemplary Embodiment

Figure 1:
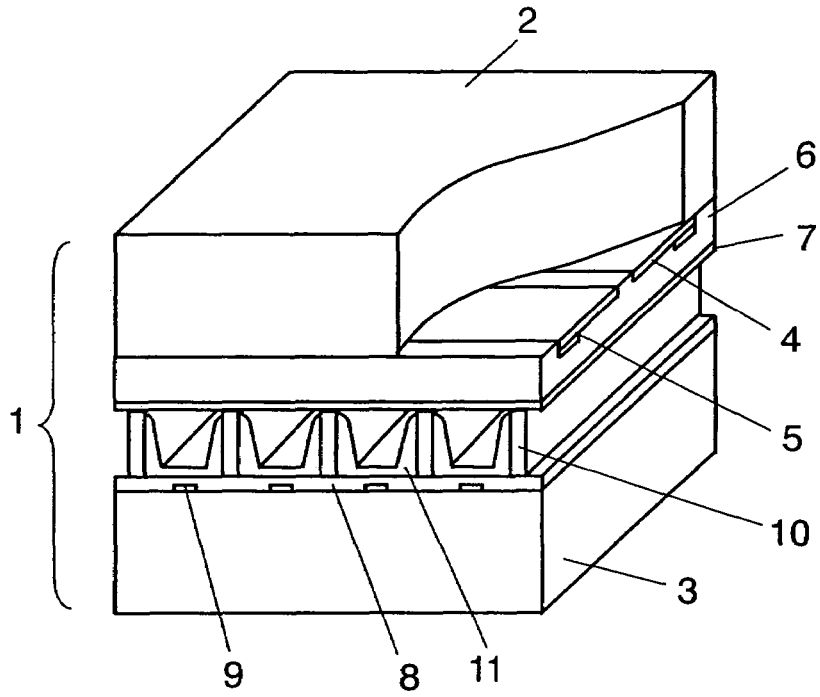
FIG. 1 is a perspective view illustrating an essential part of a panel for use in an exemplary embodiment of the present invention.

FIG. 1 is a perspective view illustrating an essential part of a panel for use in the exemplary embodiment of the present invention. Panel 1 is composed of front substrate 2 and rear substrate 3 that are made of glass and faced with each other so as to form a discharge space therebetween. On front substrate 2, a plurality of display electrodes, each formed of a pair of scan electrode 4 and sustain electrode 5, is formed in parallel with each other. Dielectric layer 6 is formed to cover scan electrodes 4 and sustain electrodes 5. On dielectric layer 6, protective layer 7 is formed. As protective layer 7, a material having a large secondary electron emission factor and high sputter resistance is desirable to cause stable discharge. In this exemplary embodiment, MgO thin film is used. On rear substrate 3, a plurality of data electrodes 9 covered with insulating layer 8 is provided. Barrier ribs 10 are provided on insulating layer 8 between data electrodes 9 in parallel therewith. Also, phosphor layers 11 are provided on the surface of insulating layer 8 and the side faces of barrier ribs 10. Front substrate 2 and rear substrate 3 are faced with each other in a direction in which scan electrodes 4 and sustain electrodes 5 intersect with data electrodes 9. In a discharge space formed therebetween, a mixed gas, e.g. neon-xenon, is filled as a discharge gas. In this exemplary embodiment, to improve the emission efficiency of the panel, the partial pressure of xenon in the discharge gas filled into the panel is increased to 10%.

Figure 2:
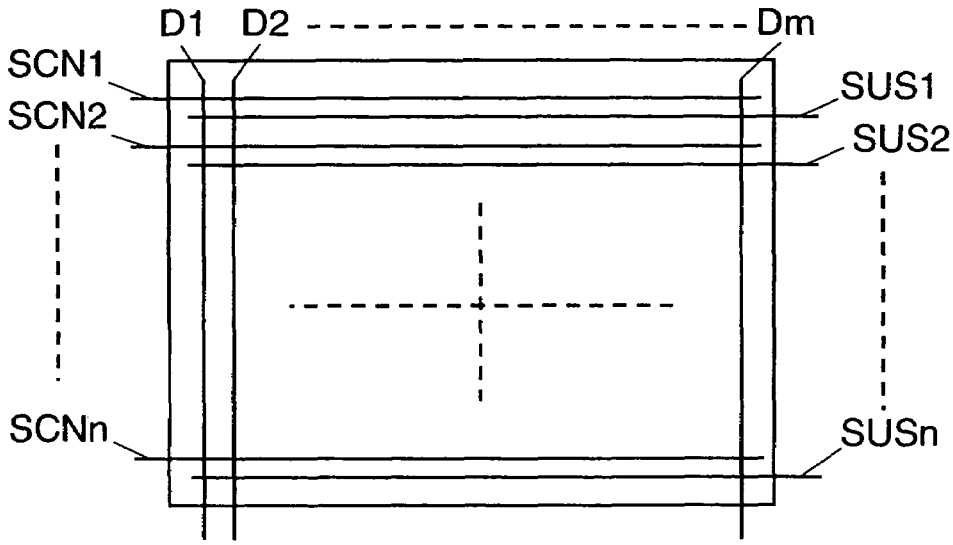
FIG. 2 is a diagram illustrating an array of electrodes of the panel.

FIG. 2 is a diagram showing an array of electrodes of the panel for use in the exemplary embodiment of the present invention. N scan electrodes SCN 1 to SCNn (scan electrodes 4 in FIG. 1) and n sustain electrodes SUS 1 to SUSn (sustain electrodes 5 in FIG. 1) are alternately disposed in a row direction. M data electrodes D1 to Dm (data electrodes 9 in FIG. 1) are disposed in a column direction. A discharge cell is formed at a portion in which a pair of scan electrode SCNi and sustain electrode SUSi (i=1 to n) intersect with one data electrode Dj (j=1 to m). Thus, m×n discharge cells are formed in the discharge space.

Figure 3:
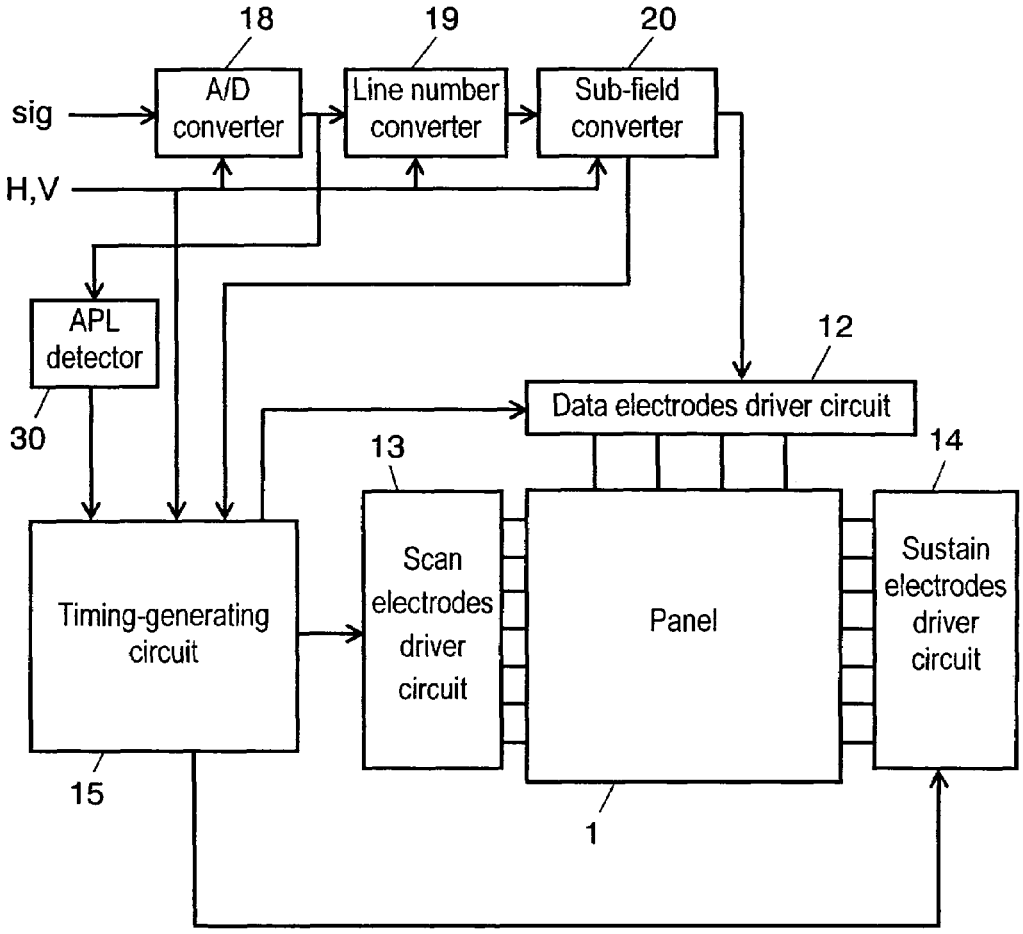
FIG. 3 is a block diagram showing a structure of a plasma display device using the method of driving a panel.

FIG. 3 is a block diagram showing a structure of a plasma display device using the method of driving a panel in accordance with the exemplary embodiment. The plasma display panel device includes panel 1, data electrodes driver circuit 12, scan electrodes driver circuit 13, sustain electrodes driver circuit 14, timing-generating circuit 15, analog-to-digital (A/D) converter 18, line number converter 19, sub-field converter 20, average picture level (APL) detector 30, and power supply circuits (not shown).

With reference to FIG. 3, image signal sig is fed into A/D converter 18. Horizontal synchronizing signal H and vertical synchronizing signal V are fed into timing-generating circuit 15, A/D converter 18, line number converter 19, and sub-field converter 20. A/D converter 18 converts image signal sig into image data of digital signals, and feeds the image data into line number converter 19 and APL detector 30. APL detector 30 detects the average picture level of the image data. Line number converter 19 converts the image data into image data corresponding to the number of pixels of panel 1, and feeds the image data to sub-field converter 20. Sub-field converter 20 divides the image data of respective pixels into a plurality of bits corresponding to a plurality of sub-fields. The image data per sub-field is fed into data electrodes driver circuit 12. Data electrodes driver circuit 12 converts the image data per sub-field into signals corresponding to respective data electrodes D1 to Dm, and drives respective data electrodes D1 to Dm.

Timing-generating circuit 15 generates timing signals based on horizontal synchronizing signal H and vertical synchronizing signal V, and feeds the timing signals to scan electrodes driver circuit 13 and sustain electrodes driver circuit 14, respectively. Responsive to the timing signals, scan electrodes driver circuit 13 feeds driving waveforms to scan electrodes SCN1 to SCNn. Responsive to the timing signals, sustain electrodes driver circuit 14 feeds driving waveforms to sustain electrodes SUS1 to SUSn. At this time, timing-generating circuit 15 controls the driving waveforms, according to an APL supplied from APL detector 30. Specifically, as described later, according to the APL, timing-generating circuit 15 determines to perform one of all-cell initializing operation and selective initializing operation in each of the sub-fields comprising one field, and controls the number of the all-cell initializing operations in one field.

Next, driving waveforms for driving the panel and their operation are described. In the exemplary embodiment, one field is divided into 10 sub-fields (from a first SF to 10-th SF), and each of the sub-fields has a brightness weight of 1, 2, 3, 6, 11, 18, 30, 44, 60, or 80. In this manner, one field is structured so that the later sub-filed has a larger brightness weight.

Figure 4:
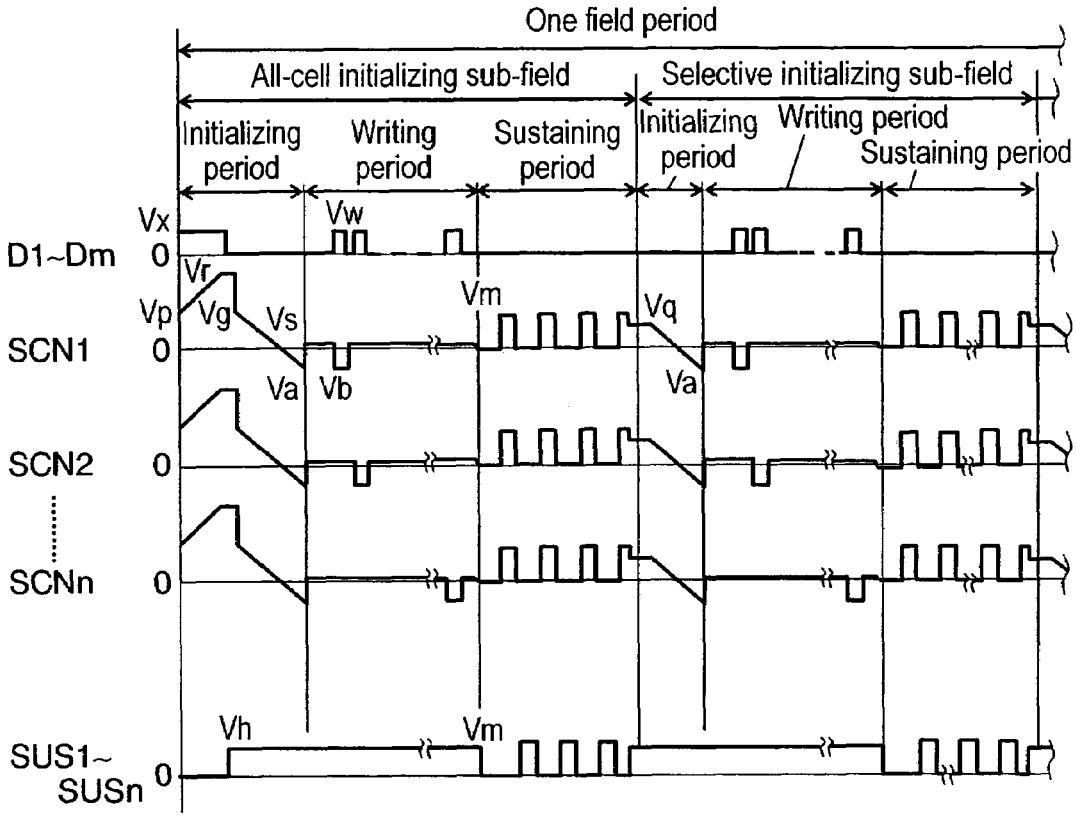
FIG. 4 is a diagram showing driving waveforms applied to the respective electrodes of the panel.

FIG. 4 is a diagram showing driving waveforms applied to respective electrodes of the panel for use in the exemplary embodiment of the present invention The diagram shows driving waveforms applied to a sub-field having an initializing period for performing all-cell initializing operation (hereinafter abbreviated as "all-cell initializing sub-field") and a sub-field having an initializing period for performing selective initializing operation (hereinafter abbreviated as "selective initializing sub-field"). In FIG. 4, for simple description, the first sub-field is shown as an all-cell initializing sub-field, and the second sub-field is shown as a selective initializing sub-field.

First, the driving waveforms in the all-cell initializing sub-field and their operation are described.

In the former half of the initializing period, while sustain electrodes SUS1 to SUSn are kept at 0 (V) and data electrodes D1 to Dm are kept at positive voltage Vx (V), a ramp voltage gradually increasing from voltage Vp (V) not higher than a discharge-starting voltage to voltage Vr (V) exceeding the discharge-starting voltage is applied to scan electrodes SCN1 to SCNn. This operation causes a weak initializing discharge using scan electrodes SCN1 to SCNn as anodes, and sustain electrodes SUS1 to SUSn as cathodes, because positive voltage Vx (V) weakens the electric field between the data electrodes and the scan electrodes. This discharge is stable because the surfaces of sustain electrodes SUS1 to SUSn, i.e. the cathodes, are covered with protective layer 7 having a large secondary electron emission factor. Subsequently, a weak initializing discharge occurs between scan electrodes SCN1 to SCNn, i.e. anodes, and data electrodes D1 to Dm i.e. cathodes. This discharge is stable because the priming has been sufficiently generated by the discharge using sustain electrodes SUS1 to SUSn as the cathodes, although the data electrodes have phosphors having smaller secondary electron emission factors applied thereto. In this manner, the all-cell initializing operation causes a first weak but stable initializing discharge in all the discharge cells. Thus, negative wall voltage accumulates on scan electrodes SCN1 to SCNn and positive wall voltage accumulates on sustain electrodes SUS1 to SUSn and data electrodes D1 to Dm. Now, the wall voltage on electrodes indicates a voltage generated by wall electric charge that has accumulated on the dielectric layer or phosphor layers covering the electrodes.

In the latter half of the initializing period, while sustain electrodes SUS1 to SUSn are kept at positive voltage Vh (V), a ramp waveform voltage gradually decreasing from voltage Vg (V) to voltage Va(V) is applied to scan electrodes SCN1 to SCNn. This operation causes a second weak initializing discharge using scan electrodes SCN1 to SCNn as cathodes, and sustain electrodes SUS1 to SUSn and data electrodes D1 to Dm as anodes, in all the discharge cells. Then, the wall voltage on scan electrodes SCN1 to SCNn and the wall voltage on sustain electrodes SUS1 to SUSn are weakened, and the wall voltage on data electrodes D1 to Dm are adjusted to a value appropriate for writing operation. In this manner, the initializing operation in the all-cell initializing sub-field is all-cell initializing operation for causing initializing discharge in all the discharge cells.

In the subsequent writing period, scan electrodes SCN1 to SCNn are held at voltage Vs (V) once. Next, positive write pulse voltage Vw (V) is applied to data electrode Dk (k=1 to m) of a discharge cell to be lit in the first row among data electrodes D1 to Dm, and scan pulse voltage Vb (V) is applied to scan electrode SCN1 in the first row. At this time, the voltage at the intersection between data electrode Dk and scan electrode SCN1 is addition of the wall voltage on data electrode Dk and the wall voltage on scan electrode SCN1 to externally applied voltage (Vw-Vb) (V), thus exceeding the discharge-starting voltage. This causes writing discharge between data electrode Dk and scan electrode SCN1, and between sustain electrode SUS1 and scan electrode SCN1. Thus, positive wall voltage accumulates on scan electrode SCN1, negative wall voltage accumulates on sustain electrode SUS1, and negative wall voltage also accumulates on data electrode Dk in this discharge cell. In this manner, writing operation is performed in the discharge cells to be lit in the first row to accumulate wall voltage on the respective electrodes. On the other hand, the voltages at intersections of data electrodes to which positive write pulse voltage Vw (V) is not applied, and scan electrode SCN1 do not exceed the discharge-starting voltage. Thus, no writing discharge occurs in these cells. Such writing operation is sequentially performed on the cells in the second row to the n-th row, and the writing period is completed.

In the subsequent sustaining period, first, sustain electrodes SUS1 to SUSn are reset to 0V, and positive sustain pulse voltage Vm (V) is applied to scan electrodes SCN1 to SCNn. At this time, in the discharge cells in which writing discharge has occurred, the voltage across scan electrode SCNi and sustain electrode SUSi amounts to addition of the wall voltage on scan electrode SCNi and the wall voltage on sustain electrode SUSi to sustain pulse voltage Vm (V), thus exceeding the discharge-starting voltage. This causes sustaining discharge between scan electrode SCNi and sustain electrode SUSi. Thus, negative wall voltage accumulates on scan electrode SCNi, and positive wall voltage accumulates on sustain electrode SUSi. At this time, positive wall voltage also accumulates on data electrode Dk. Incidentally, in the discharge cells in which no writing discharge has occurred in the writing period, no sustaining discharge occurs, and the state of the wall voltage at the time of completion of the initializing period is maintained. Subsequently, scan electrodes SCN1 to SCNn are reset to 0V, and positive sustain pulse voltage Vm (V) is applied to sustain electrodes SUS1 to SUSn. In the discharge cells in which sustaining discharge has occurred, the voltage across sustain electrode SUSi and scan electrode SCNi exceeds the discharge-starting voltage. This causes sustaining discharge between sustain electrode SUSi and scan electrode SCNi again. Thus, negative wall voltage accumulates on sustain electrode SUSi, and positive wall voltage accumulates on scan electrode SCNi. Applying sustain pulses alternately across scan electrodes SN1 to SCNn and sustain electrodes SUS1 to SUSn in a similar manner can continue sustaining discharge in the discharge cells in which writing discharge has occurred in the writing period. At the end of the sustaining period, the wall voltage on scan electrodes SCN1 to SCNn and sustain electrodes SUS1 to SUSn are erased by applying a so-called thin pulse across scan electrodes SCN1 to SCNn and sustain electrodes SUS1 to SUSn while leaving the positive wall voltage on data electrode Dk. Thus, the sustaining operation in the sustaining period is completed.

Next, the driving waveforms in the selective initializing sub-field and their operation are described.

In the initializing period, sustain electrodes SUS1 to SUSn are kept at voltage Vh (V), data electrodes D1 to Dm are kept at 0V, and a ramp voltage gradually decreasing from voltage Vq (V) to voltage Va(V) is applied to scan electrodes SCN1 to SCNn. This operation causes weak initializing discharge in the discharge cells in which sustaining discharge has occurred in the sustaining period of the preceding sub-field. The wall voltage on scan electrode SCNi and the wall voltage on sustain electrode SUSi are weakened, and the wall voltage on data electrode Dk is adjusted to a value appropriate for writing operation. On the other hand, in the discharge cells in which writing discharge or sustaining discharge has not occurred in the preceding sub-field, no discharge occurs and the state of the wall charge at the time of completion of the initializing period in the preceding sub-field is maintained. Thus, the operation in the initializing period of the selective initializing sub-field is selective initializing operation in which initializing discharge occurs in the discharge cells subjected to sustaining discharge in the preceding sub-field.

The writing period and sustaining period are the same as those of the all-cell initializing sub-field. Thus, the description is omitted.

Now, a description is provided again of the reason why voltage Vx (V) for delaying the discharge using the data electrodes as cathodes after the initializing discharge using the sustain electrodes as the cathodes is applied to the data electrodes in the all-cell initializing period. In the former half of the initializing period, applying a gradually increasing ramp voltage to scan electrodes SCN1 to SCNn causes a weak initializing discharge using sustain electrodes SUS1 to SUSn and data electrodes D1 to Dm as cathodes. At this time, because the surfaces of sustain electrodes SUS1 to SUSn are covered with protective layer 7 having a large secondary electron emission factor, the discharge using sustain electrodes SUS1 to SUSn as the cathodes is relatively stable. However, because the surfaces of data electrodes D1 to Dm are covered with phosphor layers 11 having smaller secondary electron emission factors, the insufficient priming is likely to destabilize the discharge using data electrodes D1 to Dm as the cathodes. In particular, a higher partial pressure of xenon filled into the panel increases this tendency. Therefore, to cause stable initializing discharge, first, a weak initializing discharge must be caused using sustain electrodes SUS1 to SUSn as the cathodes. Then, making the use of the priming generated in the weak initializing discharge, another weak initializing discharge must be caused in a stable manner using data electrodes D1 to Dm as the cathodes. For this purpose, voltage Vx (V) for delaying the discharge using the data electrodes as the cathodes after the initializing discharge using the sustain electrodes as the cathodes is applied to data electrodes D1 to Dm so that the weak initializing discharge using sustain electrodes SUS1 to SUSn as the cathodes precedes.

Next, a description is provided of a structure of sub-fields in the method of driving a panel of this embodiment. As described above, in this embodiment, one field is divided into 10 sub-fields (a first to 10th SFs). In the description, each of the sub-fields has a brightness weight of 1, 2, 3, 6, 11, 18, 30, 44, 60 or 80. However, the number of sub-fields or the brightness weight of each sub-field is not limited to the above values.

Figure 5:
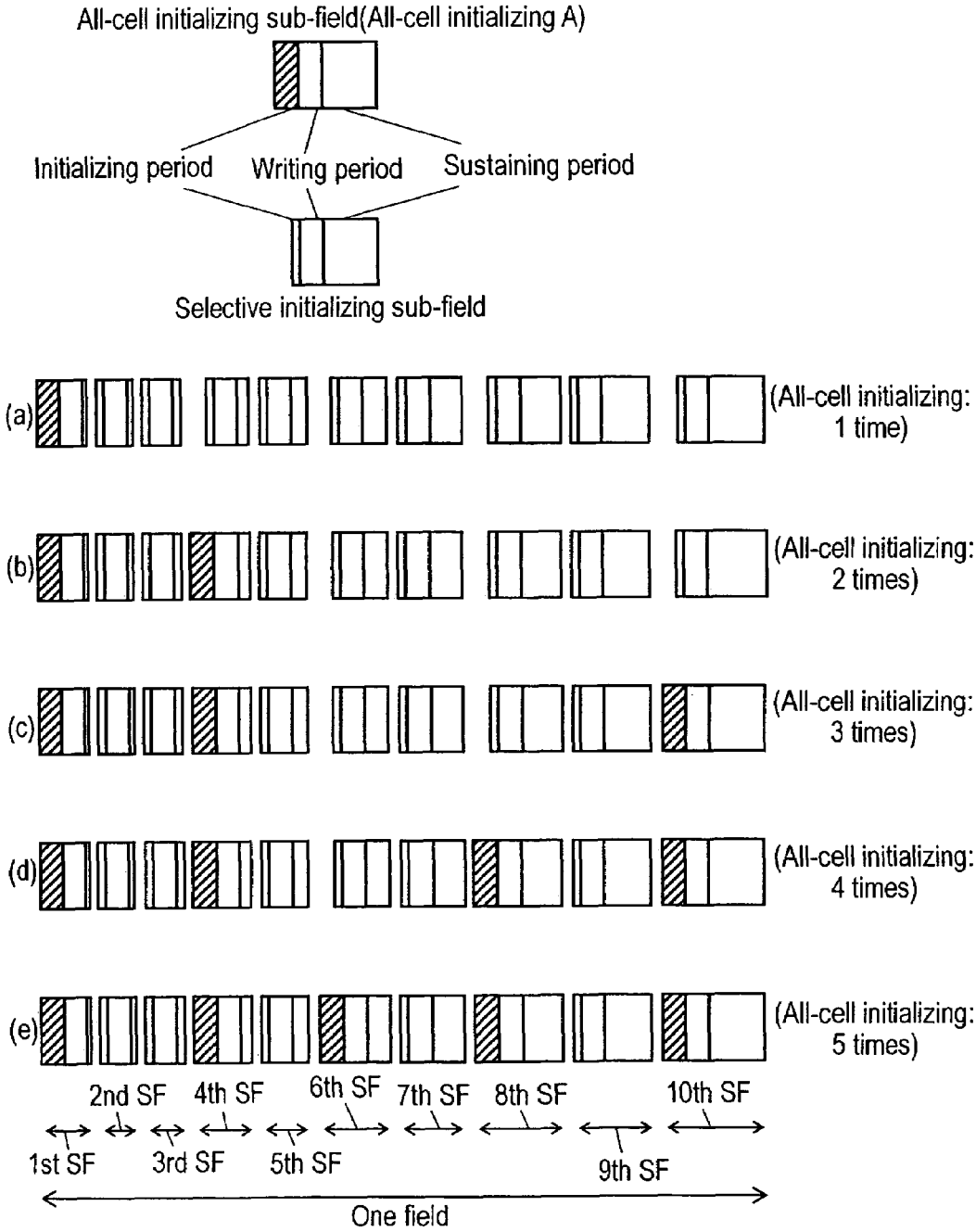
FIG. 5 is a diagram illustrating a structure of sub-fields in the method of driving a panel.

FIG. 5 is a diagram illustrating a structure of sub-fields (SF) of the method of driving a panel in accordance with the exemplary embodiment of the present invention. The sub-field structure is changed according to the APL of the signals of an image to be displayed. FIG. 5(*a*) shows a structure to be used for image signals having an APL ranging from 0 to 1.5%. In this SF structure, all-cell initializing operation is performed only in the initializing period of the first SF; selective initializing operation is performed in the initializing periods of the second to 10th SFs. FIG. 5(*b*) shows a structure to be used for image signals having an APL ranging from 1.5 to 5%. In this SF structure, all-cell initializing operation is performed in the initializing periods of the first and 4th SFs; selective initializing operation is performed in the initializing periods of the second, third, and fifth to 10th SFs. FIG. 5(*c*) shows a structure to be used for image signals having an APL ranging from 5 to 10%. In this SF structure, the first, fourth and 10th SFs are all-cell initializing SFs; the second, third, fifth to ninth SFs are selective initializing SFs. FIG. 5(*d*) shows a structure to be used for image signals having an APL ranging from 10 to 15%. In this SF structure, the first, fourth, eighth and 10th SFs are all-cell initializing SFs; the second, third, fifth to seventh, and ninth SFs are selective initializing SFs. FIG. 5(*e*) shows a structure to be used for image signals having an APL ranging from 15 to 100%. In this SF structure, the first, fourth, sixth, eighth and 10th SFs are all-cell initializing SFs; the second, third, fifth, seventh, and ninth SFs are selective initializing SFs. Table 1 shows relations between the above SF structures and APLs.

TABLE 1

| APL(%) | Number of all-cell initializing operations (times) | All-cell initializing SFs |
|---|---|---|
| 0 to 1.5 | 1 | 1 |
| 1.5 to 5 | 2 | 1, 4 |
| 5 to 10 | 3 | 1, 4, 10 |
| 10 to 15 | 4 | 1, 4, 8, 10 |
| 15 to 100 | 5 | 1, 4, 6, 8, 10 |

As described above, in this exemplary embodiment, because it is considered that there is no or a small area displaying a black picture when an image having a large APL is displayed, the number of all-cell initializing operations and thus priming are increased to stabilize discharge. In contrast, when an image having a low APL is displayed, it is considered that there is a large area displaying a black picture. Thus, the number of all-cell initializing operations and the black picture level are reduced to improve black display quality. Therefore, at a low APL, luminance in the area displaying a black picture is low, and an image having high contrast can be displayed even when the image has areas having high luminance.

The number of all-cell initializing operations per one field is determined so as to depend on the APL. During the initializing discharge using the scan electrodes as the anodes and sustain electrodes and data electrodes as the cathodes in the all-cell initializing period, the initializing discharge can be stabilized by applying, to the data electrodes, voltage Vx (V) for delaying the discharge using the data electrodes as the cathodes after the initializing discharge using the sustain electrodes as the cathodes.

In this exemplary embodiment, one field is composed of 10 SFs and the number of all-cell initializing operations is controlled to one to five times, as an example. However, the present invention is not limited to this example. Tables 2 and 3 show other examples.

TABLE 2

| APL(%) | Number of all-cell initializing operations (times) | All-cell initializing SFs |
|---|---|---|
| 0.0 to 1.5 | 1 | 1 |
| 1.5 to 5 | 2 | 1, 9 |
| 5 to 10 | 3 | 1, 4, 9 |
| 10 to 100 | 4 | 1, 4, 8, 10 |

TABLE 3

| APL(%) | Number of all-cell initializing operations (times) | All-cell initializing SFs |
|---|---|---|
| 0.0 to 1.5 | 1 | 1 |
| 1.5 to 5 | 2 | 1, 4 |
| 5 to 100 | 3 | 1, 4, 6 |

In Table 2, the number of all-cell initializing operations is controlled to one to four times, and the SFs in which all-cell initializing operation is performed are changed, as an example. In Table 3, the number of all-cell initializing operations is controlled to one to three times, and the SFs near the top of one field are initialized preferentially, as an example.

Incidentally, voltage Vx (V) to be applied to the data electrodes can be any voltage if it can delay the discharge using the data electrodes as cathodes after the initializing discharge using the sustain electrodes as the cathodes. In the exemplary embodiment, voltage Vx (V) is set to a voltage the same as write pulse voltage Vw (V). This setting can simplify the circuit structure.

As described above, in the method of driving a panel of this exemplary embodiment, applying voltage Vx (V) to the data electrodes in the all-cell initializing period can stabilize the initializing discharge, and thus display images in excellent quality, even with a panel having a higher partial pressure of xenon in the discharge gas filled into the panel.

Thus, the present invention can provide a method of driving a plasma display panel in which stabilization of initializing discharge allows images to be displayed in excellent quality.

INDUSTRIAL APPLICABILITY

In the method of driving a panel of this invention, stabilization of initializing discharge allows images to be displayed in excellent quality. The present invention is useful for an image display device or the like, using a plasma display panel.

The invention claimed is:

1. A method of driving a plasma display panel, the plasma display panel including discharge cells, each of the discharge cells formed at an intersection of a scan electrode and a sustain electrode, and a data electrode, the method comprising:

dividing one field period into a plurality of sub-fields, each sub-field having an initializing period, writing period, and sustaining period;

in the initializing periods of the plurality of sub-fields, performing one of all-cell initializing operation and selective initializing operation, wherein, the all-cell initializing operation causes initializing discharge by applying a slowly ascending voltage from voltage Vp below discharge starting voltage toward voltage Vr exceeding the discharge starting voltage to the scan electrodes of all discharge cells for displaying an image, and applying a slowly descending voltage from voltage Vg smaller than the voltage Vr to voltage Va to the scan electrodes and, the selective initializing operation selectively causes initializing discharge only in the discharge cells subjected to sustaining discharge in the preceding sub-field by applying a slowly descending voltage from voltage Vq to voltage Va to the scan electrodes; and during the initializing period of initializing all cells, holding the sustain electrodes at 0 (V) and holding the data electrodes at positive voltage Vx, and causing initializing discharge between the scan electrodes and the sustain electrodes when applying the slowly ascending voltage from voltage Vp below discharge starting voltage toward voltage Vr exceeding the discharge starting voltage to the scan electrodes, and holding the sustain electrodes at positive voltage Vh and holding the data electrodes at 0 (V), and causing second initializing discharge between the scan electrodes, the sustain electrodes and the data electrodes when applying the slowly descending voltage from voltage Vg to voltage Va to the scan electrodes.

* * * * *